United States Patent [19]

Hamilton et al.

[11] Patent Number: 4,583,480

[45] Date of Patent: Apr. 22, 1986

[54] KAYAK COCKPIT COVER

[76] Inventors: Don A. Hamilton, 108 Buena Vista Dr.; William E. Masters, 313 Dogwood La., both of Easley, S.C. 29640

[21] Appl. No.: 577,054

[22] Filed: Feb. 6, 1984

[51] Int. Cl.[4] ..... B63B 19/00

[52] U.S. Cl. ..... 114/347; 114/361

[58] Field of Search ..... 114/347, 361, 364, 345, 114/351, 103; 24/17 AP, 16 PB, 30 P, 30.5 T; 150/52 R; 220/200, 213, 232, 305, 306, 354; 215/272, 317

[56] References Cited

U.S. PATENT DOCUMENTS

| | | | |
|---|---|---|---|
| 2,691,977 | 10/1954 | Wallin | 220/200 |
| 3,486,788 | 12/1969 | Benton | 114/361 |
| 3,532,244 | 10/1970 | Yates, Jr. | 215/272 |
| 3,698,409 | 10/1972 | Koontz et al. | 114/361 |

FOREIGN PATENT DOCUMENTS

| | | | |
|---|---|---|---|
| 0424910 | 2/1926 | Fed. Rep. of Germany | 114/347 |
| 1277696 | 9/1968 | Fed. Rep. of Germany | 114/347 |

*Primary Examiner*—Galen L. Barefoot
*Assistant Examiner*—Edwin L. Swinehart
*Attorney, Agent, or Firm*—Cort Flint

[57] ABSTRACT

A spray skirt (A) is disclosed for covering the cockpit opening (14) of a kayak (10). The spray skirt includes a fabric cover (24) for spanning the opening which includes an elastic band (B) secured around the perimeter of the cover for retaining the spray skirt about a rim (16) of the opening. The retaining band includes outer and inner elastic bands (30, 32) joined by a compressible bulbous retaining element (34). The bulbous retaining element is rounded and rolls over a lip (18) of the rim and compresses to interlock in a channel (36) beneath the lip. The inner band 32 is of sufficient width to prevent contact of the interior fabric (24*b*) of the cover from being abraded by lip contact. Upon initial rolling of the retaining element (34) over the lip, the entire retaining band snaps off the rim for quick removal.

12 Claims, 8 Drawing Figures

KAYAK COCKPIT COVER

BACKGROUND OF THE INVENTION

The invention relates to a cockpit cover for covering the seat opening of a kayak and the like boat which fits about the waist of the boater and over a rim about the cockpit to seal the cockpit opening against the entry of water. Kayaks are susceptible to being turned over in use and it is desirable to be able to return the kayak to an upright position while the boater remains seated. When used under whitewater conditions entry of water into the hull interior through the cockpit opening is highly likely. For the above reasons, a cover which will fit about the boater and the cockpit opening to seal effectively against the entry of water is a problem to which considerable attention need be given. In case of emergency, the boater must be able to remove the cover quickly without failure so that he may escape the kayak or boat.

Heretofore, covers have been proposed and utilized which include a cover made of foam rubber material for covering the cockpit having a fitted opening which fits about the waist of a boater. The covers have utilized an elastic band stretched around the circumference of the cockpit and fitted underneath the lip of the rim of the cockpit. Once seated in the cockpit, the boater stretches the cover about the rim of the opening and secures the rubber band under the lip of the rim. However, the band is attached to the exterior surface of the cover, leaving the interior surface of the cover unprotected. The problem occurs that the interior surface of the cover is fitted against the rim lip and is highly susceptible to abrasion as the boater's body twists and turns in use pulling the cover against the lip of the boat abrading the cover. The rubber band which is typically flat also requires a good bit of effort to be pulled out from under the rim lip around the perimeter of the cockpit opening. Other methods such as drawstrings also leave the cover exposed for abrading and require considerable effort in fastening and unfastening the cockpit cover. Elastic shock cords have also been utilized as a drawstring, which also are required to be pulled and tied for fitting about the rim.

Other devices of general interest are shown in U.S. Pat. Nos. 4,031,580 and 1,284,968.

Accordingly, an important object of the present invention is to provide a spray skirt for covering the cockpit opening of a kayak and the like which has a non-abrading edge which fits against an undereath lip of the rim of the cockpit.

Another important object of the present invention is to provide a spray skirt for covering the cockpit opening of a kayak having a unique elastic retaining edge with a design element which provides a snap action to quickly remove the skirt from the cockpit opening once removal is initiated.

Still another important object of the present invention is to provide a spray skirt having an elastic retaining member around the perimeter of the spray skirt having a hollow rounded bulbous cross-section which enables the skirt to roll off quickly from the lip of the cockpit rim for quick removal.

Still another important object of the present invention is to provide a spray skirt for covering the cockpit opening of a kayak and the like which has an elastic retaining element around the perimeter of the cover fitting underneath the lip of the cockpit rim which provides a snap-on and snap-off action and an auxiliary tensioning member by which the retaining element of the spray skirt may be additionally tensioned for retention about the cockpit rim.

Still another important object of the present invention is to provide a spray skirt for covering the cockpit opening of a kayak which may be adjusted for tightness so as to be carried about the cockpit opening and retained under a variety of water roughness conditions.

SUMMARY OF THE INVENTION

The above objectives are accomplished according to the present invention by providing a spray skirt cover constructed of nylon coated neoprene fabric or material for covering the cockpit opening of a kayak. The spray skirt cover includes an elastic occupant opening for fitting around the waist of a boater. The spray skirt cover includes around its edge a specially designed elastic retaining band for fitting underneath a lip of the rim of the cockpit. The elastic retaining band includes an outer elastic band which is secured to an exterior surface of the cover and an inner elastic band which covers an interior edge of the cover. The outer elastic band and the inner elastic band are joined by an elastic compressible bulbous element which is hollow and has a rounded cross-sectional configuration. The inner elastic band has a sufficient radial extent such that it fits against the lip of the cockpit rim when the cover is fitted about the rim during use. The elastic bulbous element rolls around the rim of the cockpit to fit underneath the lip of the rim. During both fitting and removal of the spray skirt around the cockpit opening the elastic bulbous element rolls about the rim to snap on and off the rim. When removing the spray skirt, the forward end of the spray skirt is pulled by means of a strap handle attached to the front of the spray skirt. Once the elastic bulbous retaining element is initially pulled up and over the lip, the entire retaining band around the perimeter of the spray skirt begins to roll quickly up off of the lip for quick removal. Perimetrical ribs are formed on the elastic bulbous retaining element in the direction of the perimeter of the retaining band to grip the lip of the cockpit rim during use.

A quick adjustable auxiliary tensioning member may be utilized within the hollow bulbous retaining element to provide additional tensioning and adjustable tensioning for fitting the spray skirt on the cockpit rim. In a preferred embodiment, the auxiliary tensioning member is a length of surgical tubing joined end-to-end by means of a dowel fitted into the hollow diameter of the tubing ends. The retaining band may be cut at the rear of the spray skirt and the surgical tubing may be pulled through the cut opening for adjustment of the length of the tubing. By pulling one end of the tubing from the wood dowel and cutting off a section of the tubing, the tubing may be fitted back on the dowel in its shortened configuration quickly while in use. Under severe whitewater conditions an extremely tight spray skirt fitting is desirable and this can be accomplished by shortening the surgical tubing quickly in use.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
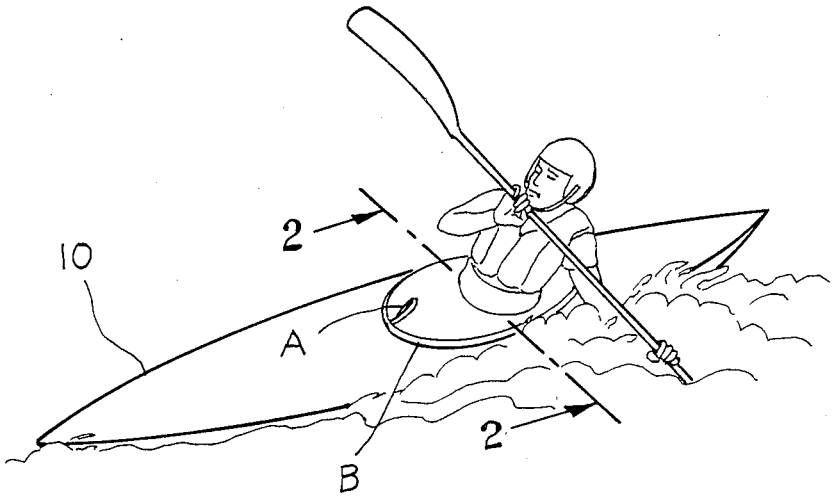
FIG. 1 is a perspective view illustrating a kayak having a spray skirt constructed according to the present invention for covering the kayak cockpit opening and protecting the kayak from entry of water.
Figure 2:
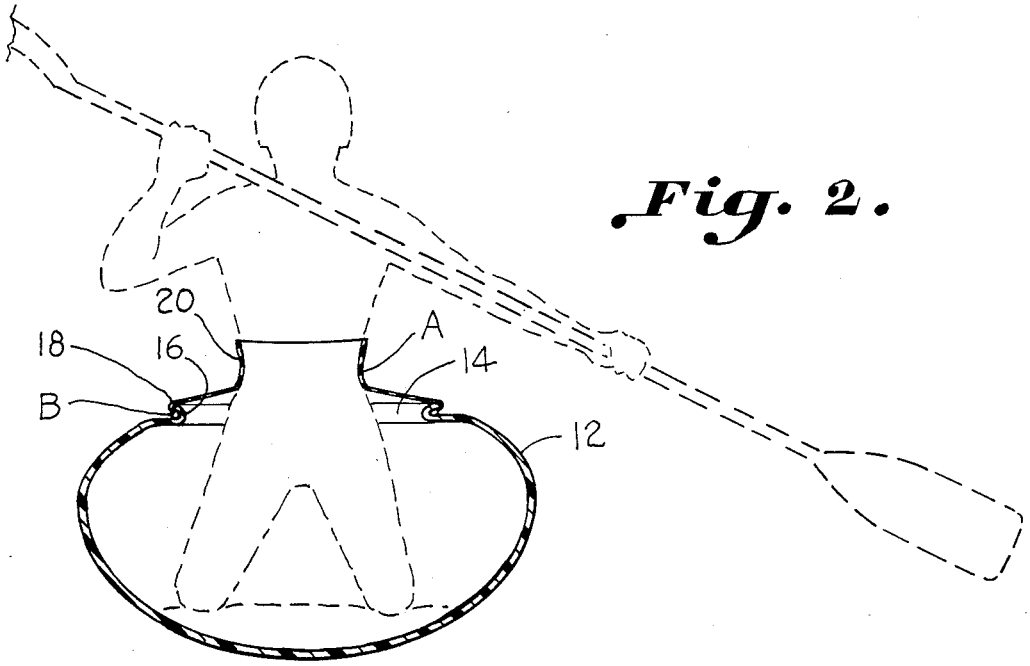
FIG. 2 is a sectional view taken along line 2—2 of FIG. 1.
Figure 3:
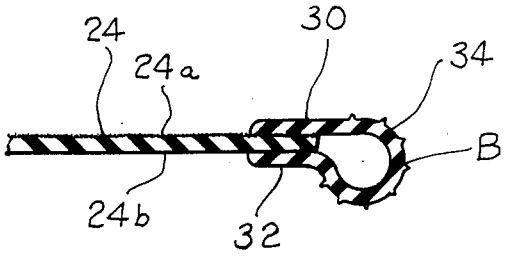
FIG. 3 is an enlarged sectional view of a retaining band for retaining a spray skirt fitted about the rim of a kayak cockpit opening according to the present invention.
Figure 4:
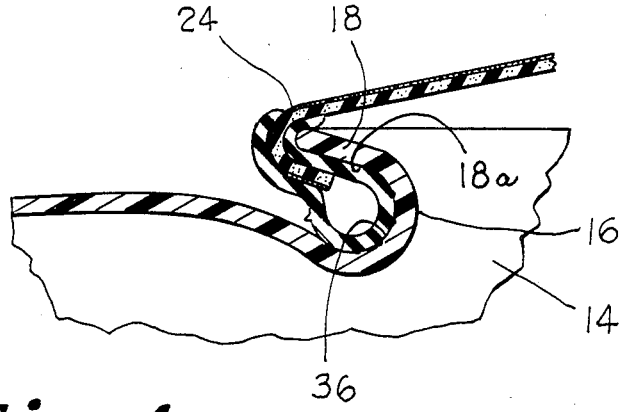
FIG. 4 is an enlarged sectional view illustrating the retaining band constructed according to the present invention retaining the spray skirt fitted about the rim opening of a cockpit.

Referring now in more detail to the drawings, a kayak is illustrated at 10 which includes a rounded exterior hull 12. The boater is illustrated on his knees in FIG. 2 which would correspond to a C1-type kayak. In other types of kayaks the boater is seated. However, in either type of kayak there is a cockpit opening 14 in which the boater either sits or kneels on his knees. The cockpit opening typically includes a raised rim 16 having an outwardly overhanging lip 18 which overhangs a portion of the hull 12.

According to the invention, a spray skirt A is provided for covering the cockpit opening which fits about the waist of the boater to prevent entry of the water into the interior of the hull through the cockpit opening. The spray skirt includes a fitted opening in the form of a waistband 20 which receives and fits about the waist of the boater. A strap handle 22 is provided on the front of the spray skirt. A spray skirt cover 24 spans the cockpit opening 14 when fitted about the rim 16. The spray skirt cover is typically made of a nylon coated neoprene material referred to as fabric herein.

An elastic retaining band B is carried around an outer perimeter of the spray skirt cover. The retaining band includes an outer elastic band 30 secured to an exterior surface 24*a* of the cover and an inner elastic band 32 carried on and secured to an interior surface 24*b* of the spray skirt cover. A compressible bulbous retaining element 34 joins the outer and inner bands 30 and 32 in a one-piece strip around the perimeter of the cover. The bulbous retaining element 34 is rounded in its cross-section such that it rolls on and off the lip 18 of the rim 16 to facilitate quick removal of the spray skirt cover from the opening as is required in emergency conditions to free the boater. Once the front of the spray skirt cover is pulled upwards by means of the strap 22, the rounded bulbous element 34 comes off of the lip 18 and generally simultaneously therewith the entire retaining element rolls off of the lip around the entire perimeter of the cockpit rim. Being compressible, the bulbous retaining element 34 fits good under an underneath surface 18*a* of the lip and compresses to insure a good tight fit as needed underneath the lip and in a notch 36 formed between the rim and the hull of the boat.

The inner elastic band 32 has such an extent toward the center of the spray skirt cover such that it covers the entire underneath surface 18*a* of the lip and extends above the top of the lip 18 to completely protect the fabric of the spray skirt cover against abrading by the hard material of the rim and lip 18. The bands may be secured by any suitable adhesive.

Figure 5:
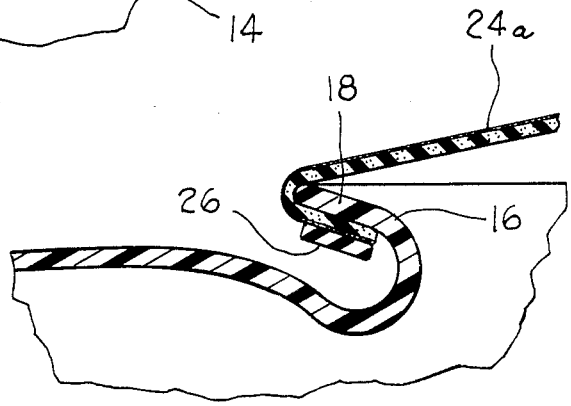
Fig. 5. PRIOR ART
FIG. 5 is a sectional view illustrating a prior art spray skirt and elastic retaining band.
Figure 6:
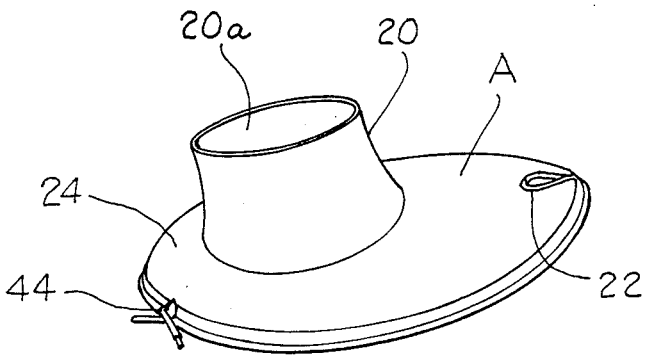
FIG. 6 is a perspective view of a spray skirt and retaining band having an auxiliary tensioning member which may be adjustable according to the invention.
Figure 7:
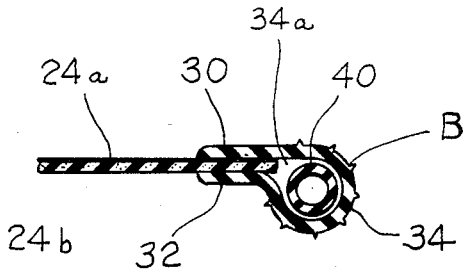
FIG. 7 is a sectional view of a retaining band having an auxiliary tensioning member for retaining a spray skirt covering a kayak cockpit opening according to the invention.
Figure 8:
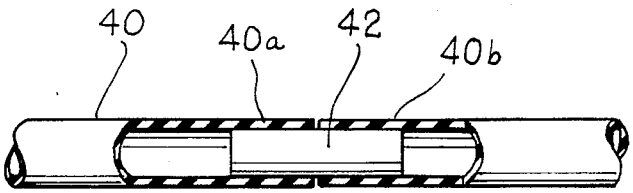
FIG. 8 is a sectional view illustrating an adjustable tensioning member for retaining a spray skirt covering about a cockpit opening of a kayak which may be adjustable according to the invention.

As illustrated in FIG. 5, the prior art has contemplated the use of a flat elastic retaining band 26 on the exterior surface of the spray skirt cover 24 thus leaving the interior surface of the spray skirt cover unprotected against abrasion by the lip. Furthermore, the flat elastic band 26 does not provide for quick removal from the lip since it is twisted and tends to stay against the underneath surface of the lip upon initial removal of the band. There is no rolling off action provided as in the case of the present invention.

An auxiliary tensioning member 40 is carried concentrically within the hollow portion 34*a* of the bulbous element to provide tensioning of the element about the rim of the cockpit opening. As illustrated, the tensioning member 40 includes a length of surgical type tubing joined end-to-end by means of a dowel pin 42. When it is desired to adjust the tension of the fitting of the spray skirt about the cockpit opening, the bulbous element 34 may be cut such as at 44 at the rear of the spray skirt cover. The tubing may then be pulled through the opening and the ends 40*a* and 40*b* of the tubing separated. With the free end of the tubing separated, the tubing may be cut and shortened whereby when rejoined the tension of the member 40 is increased. This provides for adjustable tensioning of the spray skirt in use to tighten the spray skirt cover about the cockpit opening such as in the case of intense whitewater conditions where the forced water against the spray skirt cover is great.

Raised perimetal ribs 50 are molded rubber bulbous elements 34 to grip the lip 18 of the rim for better retention and release.

It will be understood, of course, that while the form of the invention herein shown and described constitutes a preferred embodiment of the invention, it is not intended to illustrate all possible form of the invention. It will also be understood that the words used are words of description rather than of limitation and that various changes may be made without departing from the spirit and scope of the invention herein described.

What is claimed is:

1. A spray skirt for covering the cockpit seat opening, said cockpit opening being of the type of a kayak and the like having a raised rim around the perimeter of the opening with an outwardly extending lip overhanging the hull of said kayak, said spray skirt comprising:

a spray skirt fabric cover for spanning the cockpit opening and preventing the entry of water into said opening;

a fitted opening formed in said cover for fitting around the waist of a boater;

an inner elastic band carried about an interior surface of a perimeter of said fabric cover;

a bulbous elastic retaining element carried by said perimeter of said spray skirt cover adjoining said elastic band;

said elastic band and bulbous elastic retaining element being stretchable to facilitate placement over said rim of said cockpit and elastic retention underneath said lip of said rim;

said bulbous retaining element being compressible and having a rounded cross-section facilitating rolling of said entire retaining element over the lip of said rim to remove said spray skirt quickly upon initial pulling of said retaining element over said lip;

said elastic band having a sufficient inward extent toward said fitted opening for engaging an underneath surface of said lip of said cockpit rim to prevent abrading of said fabric cover against said rim when said spray skirt cover is attached to said opening; and said inner elastic band and said elastic bulbous retaining element are one piece, and including an outer elastic band secured to an exterior surface of said spray skirt which is one-piece with said inner elastic band and bulbous retaining element.

2. The device of claim 1 wherein said bulbous retaining element includes ribs raised from the surface of said element extending around said bulbous retaining element in the direction of the perimeter of said spray skirt for resiliently gripping said rim.

3. The device of claim 1 wherein said bulbous retaining element is hollow facilitating compression and snapping of said element about said lip of said rim.

4. The device of claim 3 including an auxiliary tensioning element carried in and concentric with said hollow bulbous element around the perimeter of said spray skirt tensioning said bulbous retaining element about said rim.

5. The device of claim 4 including an access opening formed in said bulbous retaining element affording access to said tensioning member, and tension adjustment means accessible through said access opening for adjusting the tension of said tensioning member to vary the tension on said retaining element.

6. The device of claim 5 wherein said tension member includes a length of hollow elastic tubing joined end-to-end, a connecting pin received in an interior bore of said tubing at said ends joining said tubing end-to-end so that said ends of said tubing may be separated and cut to shorten said tubing and adjust its tension.

7. A spray skirt for protecting the cockpit seat opening of a kayak and the like from the entry of water, said cockpit opening being of the type having a raised rim surrounding the opening with an outwardly extending lip adjacent a free edge of said rim overhanging the hull of said kayak, said spray skirt comprising:

a spray skirt cover spanning said cockpit opening and preventing entry of water through said opening;

said spray skirt cover having an outer free edge, and a fitted opening for receiving and fitting about the waist of the boater;

said spray skirt covering having an outer exterior surface and an inner interior surface when fitted over said cockpit opening;

an elastic retaining band secured to said outer free edge of said spray cover about a perimeter of said cover;

a compressible bulbous retaining element integral with said retaining band including a stretchable, compressible bulb means having a hollow unfilled interior for enabling said bulbous retaining element to stretch and snap over said rim and be elastically retained just underneath said lip of said cockpit rim facilitating quick attachment of said spray skirt cover; and said hollow bulb means generally rounded and compressible for grippingly rolling from underneath said lip and snapping off of said rim for quick release therefrom.

8. The device of claim 7 wherein said bulbous retaining element is hollow to provide compressibility with retention underneath said lip of said rim.

9. A spray skirt for protecting the cockpit seat opening of a kayak and the like from the entry of water, said cockpit opening being of the type having a raised rim surrounding the opening of an outwardly extending lip adjacent a free edge of said rim overhanging the hull of said kayak, said spray skirt comprising;

a spray skirt cover for spanning said cockpit opening and preventing entry of water through said opining:

said spray skirt having an outer free edge defining the outer perimeter thereof, and a fitted opening for receiving and fitting about the waist of the boater;

said spray skirt covering having an outer exterior surface and an inner interior surface when fitted over said cockpit opening;

an elastic retaining band secured to said spray skirt cover over said inner interior surface adjacent said free edge of said cover fabric about said perimter of said cover;

a hollow compressible bulbous retaining element formed on said retaining band fitting underneath said lip adjacent said free edge of said rim, said bulbous retaining element having sufficient compressibility and resilience to roll from underneath said lip of said cockpit rim facilitating quick removal of said spray skirt cover and snap over said rim for attachment;

said elastic retaining band and bulbous retaining element being elastic and stretchable about said rim for elastic retention underneath said lip;

an auxiliary tensioning member carried freely unattached within said hollow bulbous retaining element for tensioning said retaining element about said rim; and said retaining band having a sufficient extent radially inward of said cover to engage said lip and rim when attached thereto to prevent contact of said fabric cover and abrading of said fabric of said cover.

10. The device of claim 9 including tension adjustment means for adjusting the tension of said tensioning member.

11. The device of claim 9 including an access opening formed in said bulbous retaining element affording access to said tensioning element, and tension adjustment means for adjusting the tension of said tensioning element to vary the tension of said retaining element.

12. The device of claim 9 wherein said tension member includes a length of hollow elastic tubing joined end-to-end, a connecting pin received in an interior bore of said tubing at said ends joining said tubing end-to-end so that said ends of said tubing may be separated through said access opening to cut and shorten said tubing to adjust its tension when said connecting pin is reinserted in said cut end.

* * * * *